United States Patent [19]

Gladden

[11] 3,981,240

[45] Sept. 21, 1976

[54] DETONATING CAP ASSEMBLY AND CONNECTING BUSHING

[75] Inventor: Ernest Laird Gladden, Granby, Conn.

[73] Assignee: The Ensign-Bickford Company, Simsbury, Conn.

[22] Filed: July 30, 1975

[21] Appl. No.: 600,221

[52] U.S. Cl. ..... 102/29; 102/27 R

[51] Int. Cl.[2] ..... F42B 3/10

[58] Field of Search ..... 102/27–29

[56] References Cited

UNITED STATES PATENTS

| | | | |
|---|---|---|---|
| 2,878,752 | 3/1959 | Johnson et al. | 102/28 |
| 3,180,263 | 4/1965 | Williams, Jr. | 102/28 |
| 3,371,607 | 3/1968 | Olsson | 102/27 |
| 3,817,181 | 6/1974 | Persson | 102/29 |

*Primary Examiner*—Verlin R. Pendegrass
*Attorney, Agent, or Firm*—Prutzman, Hayes, Kalb & Chilton

[57] ABSTRACT

A detonating cap assembly is provided with a fuse-retaining bushing for protecting the charge within the cap from accidental ignition by static charges accumulating on the fuse. The bushing is an elongated semi-conductive plastic member slidably received within the shell of the cap and having a longitudinally extending axial bore for receiving the fuse and providing a stand-off from the charge within the cap. The bushing incorporates a thin rupturable membrane at its innermost end within the stand-off and a side notch adjacent the membrane forming a shunt path extending laterally outwardly from the bore toward said shell for diverting static charge from the fuse toward the shell of the cap.

14 Claims, 2 Drawing Figures

FIG. 1
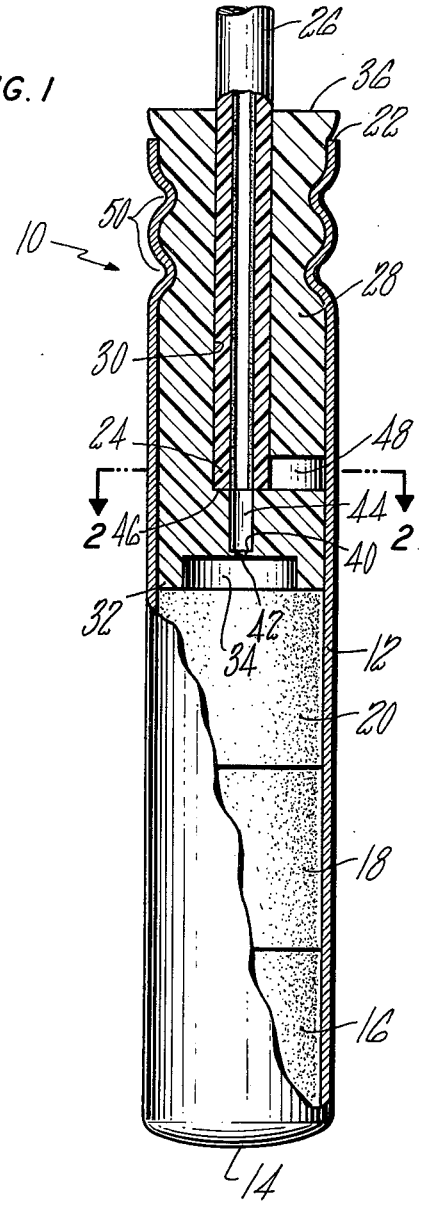
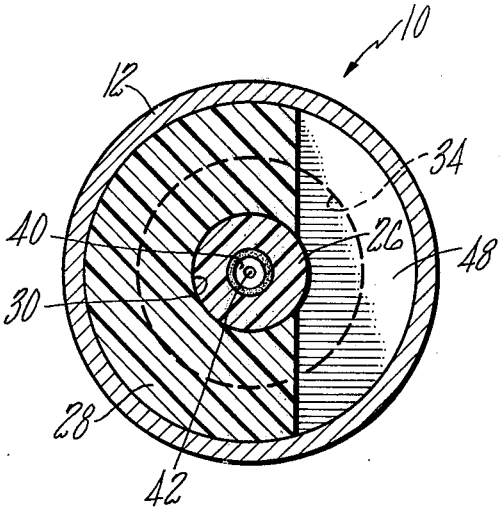
FIG. 2

DETONATING CAP ASSEMBLY AND CONNECTING BUSHING

BACKGROUND AND SUMMARY OF THE INVENTION

The present invention relates generally to a non-electrical detonating cap assembly and more particularly is concerned with a new and improved cap assembly and a bushing incorporated therein to provide a static charge shunt protecting the assembly from premature initiation.

In recent years detonating caps have been used in combination with fuses of the type consisting of a flexible plastic tube having an inner channel wall coated with a fine granular powder of reactive substances adapted to support a gaseous percussion wave throughout the length of the tube. Fuses of this type have been described in U.S. Pat. No. 3,590,739 and consist of flexible plastic tubing having a thin layer of explosive mix occupying only a small fraction of the fuse core, preferably as a part of the coating on the interior wall of the tubing. It has been reported that the explosive powder mix in such fuses has a tendency to detach from the inner wall of the fuse and accumulate on the top pyrotechnic charge within a detonating cap secured to the end of the fuse. This accumulation is reported to have prevented appropriate ignition of the cap. In order to correct this condition, it has been proposed that a spacer element be inserted between the free end of the tube and the top or delay charge within the detonating cap. This spacer element provides a shield that directs the loose powder away from the center of the top charge. Such a construction is disclosed in greater detail in U.S. Pat. No. 3,817,181 and is alleged to have the effect of assuring ignition of the cap.

The present invention relates to a different problem associated with fuses of the type described, namely the accidental initiation of the top charge due to the accumulation and flow of static charge along the length of the fuse. As mentioned, the fuse employs a plastic tubular member such as a polyethylene tube that is generally of electrically insulative character. It has been found that static charge accumulates on such a plastic fuse and will, in turn, induce a charge on the interior wall of the fuse tubing until that charge exceeds the breakdown potential of the powder film coating on the interior thereof. At this point the film becomes conductive and the charge flows along the length of the tube and into the cap causing premature ignition of the pyrotechnic delay element or booster charge and detonation of the cap. As will be appreciated, such a situation presents a substantial safety hazard.

Accordingly, it is an object of the present invention to provide a cap assembly that overcomes the aforementioned hazard and permits safe handling of fuse and cap assemblies of the type described heretofore. Included in this object is the provision for an assembly that permits full unhindered operation of the fuse and cap assembly under normal operating conditions yet isolates the pyrotechnic and explosive components from any static charge accumulation that might be present on the plastic fuse.

Another object of the present invention to provide a static charge shunt for a detonating cap assembly that includes a circuit or path of low resistance through which static charges may flow prior to reaching the pyrotechnic and explosive components of the cap. Included in this object is the provision for an interconnecting bushing between the cap and the fuse that provides a charge barrier. At the same time it prevents either contamination of the delay element by the material within the fuse or contamination of the end of the fuse by powdered material loosened from the pyrotechnic or delay charge.

Another object of the present invention is to provide an assembly of the type described that includes not only a charge barrier but also a low resistant shunt path or circuit between the end of the fuse positioned within the cap and the outer cap shell of the assembly.

Other object will be in part obvious and in part pointed out more in detail hereinafter.

These and related objects are accomplished in accordance with the present invention by providing a new and improved detonating cap assembly that includes an elongated shell open at one end for receiving a fuse, a charge in the shell spaced from the open end and an elongated bushing in the open end interconnecting the fuse to the shell of the detonating cap. The bushing has a confined end positioned adjacent the charge, a longitudinal bore extending from an exposed end to a location adjacent the confined end and a rupturable membrane at the confined end terminating the bore. The bushing further includes a low resistance shunt path adjacent the membrane and intermediate the membrane and the exposed end of the bushing. The shunt extends laterally outwardly from the bore toward the shell for diverting static charge toward the shell.

A better understanding of the invention will be obtained from the following detailed description and the accompanying drawing of an illustrative application of the invention.

BRIEF DESCRIPTION OF THE DRAWING

In the drawing:

FIG. 1 is a plan view, partially broken away and partially in section, of the cap assembly incorporating the features of the present invention; and FIG. 2 is a sectional view taken along the line 2—2 of FIG. 1

DESCRIPTION OF A PREFERRED EMBODIMENT

Refering now to the drawing in greater detail wherein like reference numerals indicate like parts within the figures, the assembly of the present invention is shown as embodied within a cap assembly 10 having a tubular shell or casing 12 of sheet metal or the like, such as aluminum, that is closed at one end 14 and houses a plurality of explosive and pyrotechnic charges. For example, a combined primary and secondary explosive charge 16 is shown positioned within shell 12 at end 14 next to which is located a suitable delay element 18 and a primer or booster charge 20. As shown, the explosive and pyrotechnic charges occupy only a portion of the cap shell 12 and are positioned at or adjacent the closed end 14 thereof so that the open end 22 of the cap shell can receive a free end 24 of an initiating fuse 26. The fuse is preferably of the type described in the forementioned U.S. Pat. No. 3,590,739 and is retained within the open end of the cap shell 12 by means of a bushing or adapter 28.

In accordance with the present invention the adapter 28 has the function not only of accommodating and retaining the free end 24 of the fuse 26 within the cap shell 12 but also of providing a means for isolating the explosive and pyrotechnic charges 16, 18, 20 in the cap from any electrostatic charges accumulated on and flowing along the fuse 26. As shown, the bushing 28 is a generally cylindrical member having an outer diameter corresponding to the internal diameter of the cap shell 12 so as to be easily and conveniently slidably received therein through open end 22. The cylindrical, fuse-retaining bushing is provided with a longitudinally extending axial bore 30 having a uniform diameter substantially equal to and slightly larger than the external diameter of the fuse 26. The bushing 28 includes a confined end portion 32 positioned adjacent and in abutting relationship to the top or booster charge 20 of the cap. The confined end 32 is provided with a circular recess 34 of shallow depth and substantially larger diameter than bore 30. As will be appreciated, the recess 34 provides at least a portion of a stand-off for the fuse while at the same time permits exposure of a substantial portion of the top surface on booster charge 20. Additionally, it permits limited movement of any loose powder on the top of booster charge 20 and some expansion of the initiating percussive wave as it leaves the fuse and prior to acting on top charge 20. The bore 30 extends from the exposed end portion 36 of the bushing 28 along the bushing to a point just short of the recess 34 so that the bore 30 and the recess 34 are separated by a thin rupturable membrane 40. Due to manufacturing variations the membrane 40 may evidence a small pin hole, shown in FIG. 2 at 42, or may be completely uninterrupted. Also the membrane may take a somewhat different configuration but should in every instance effectively terminate the bore 30 and isolate the fuse 26 from the charges within the cap shell 12.

In the preferred embodiment the bore 39 includes a reduced diameter portion 44 immediately adjacent membrane 40 forming a shoulder 46 against which rests the free end 24 of fuse 26. The shoulder 46 effectively locates and defines the preferred stand-off of the fuse when assembled in the cap. This distance may vary and is generally at least about 0.08 inch, i.e. about 0.10–0.30 inches and preferably about 0.18 to 0.23 inch. As will be appreciated, the upper limit is dictated only by practical considerations and the requisite reliable ignition of the cap by the fuse during normal operation. Generally the stand-off is about six times the radical thicknss of the bushing along the bore 30 above shoulder 46.

The rupturable membrane 40 is located at a position midway along the stand-off thereby protecting it from accidental rupture during the assembly operation. The membrane has a thickness of about 0.001–0.010 inch and preferably about 0.005 inch so that it can be easily ruptured by the initiating wave emanating from the fuse. Also, as shown, the reduced diameter portion 44 is of substantially the same diameter as the internal diameter of the fuse 26 so that the initiating wave can flow directly toward the membrane 40 from the fuse during proper functioning of the assembly.

The bushing 28 is further provided with a lateral air shunt that provides communication between the bore 30 and the cap shell 12. This shunt is preferably located at and above shoulder 46 so as to be positioned at the free end 24 of the fuse 26 and provide a low resistance flow path for accumulated electrostatic charges flowing along the fuse. In the preferred embodiment the air shunt takes the form of a notch 48 in the bushing that extends from the exterior of the bushing laterally toward and communicating with the bore 30. The particular form of the notch may be a segment, as shown, or may vary in configuration so long as it provides the desired shunt path. Conventionally, it has a radial length of about 0.03–0.05 inch, that is a length equal to the thickness of the bushing 28 between the bore 30 and its outer cylindrical wall.

The bushing is preferably a plastic member that permits crimping attachment of the shell thereto, such as at 50. Although different plastic materials may be used, polymers and copolymers of ethylene have given good results and are the preferred materials. For example, a polyethylene resin sold by E. I. duPont under the name "Alathon" has been used, as well as an ethyl vinyl acetate copolymer of polyethylene. However, the preferred materials are semi-conductive and conductive plastics such as the ethylene-ethyl acrylate copolymer containing 50 percent carbon black sold by Union Carbide as "Bakelite Semi-conductive Resin". This material is reported to have a volume resistivity of about 30–50 ohm-cm. Other equivalent materials may also be employed.

In order to test the effectiveness and reliability of the cap assemblies of the present invention, a large number of such assemblies were produced using bushing of the present invention formed from semi-conductive polyethylene-ethyl acrylate copolymeric plastic material. These bushings exhibited a standoff of about 0.18 inch and a membrane thickness of about 0.005 inch. The construction of the bushing was identical to that shown in FIG. 1 of the drawing. These bushings were used as the means of interconnecting a fuse of the type described hereinbefore to a detonating cap. Upon testing 1,000 such units having a variety of different delay elements and booster charges under highly overstressed induced static charge conditions, it was found that zero ignition occurred. However, when the bushing of the present invention was replaced with a conventional polyethylene copolymer sleeve ignition occurred in 99 percent of the test performed under identical induced static charge conditions.

As will be apparent to persons skilled in the art, various modifications, adaptations and variations of the foregoing specific disclosure can be made without departing from the teachings of the present invention.

I claim:

1. A detonating cap assembly adapted for use with a fuse having a propensity for accumulating a static charge comprising an elongated shell open at one end for receiving said fuse, a charge positioned in said shell and spaced from said one end, and a fuse retaining bushing positioned in said shell at said open end for interconnecting said fuse to said shell, said bushing being an elongated member slidably received within said shell and having a confined end adjacent said charge and an exposed end remote from said charge, a longitudinal bore in said bushing for receiving said fuse, said bore extending from said exposed end to adjacent said confined end, said bushing having a rupturable membrane at said confined end terminating said bore, said bushing including a low resistance shunt path positioned adjacent said membrane and intermediate said membrane and the exposed end of said bushing, said shunt path extending laterally outwardly from said bore toward said shell for diverting static charge from said fuse toward said shell.

2. The assembly of claim 1 wherein said bushing is a semi-conductive plastic member.

3. The assembly of claim 1 wherein said shunt path includes an air passage providing communication between said bore and said shell.

4. The assembly of claim 1 wherein said bushing includes a stand-off for said fuse and said rupturable membrane is located at an intermediate position along said stand-off.

5. The assembly of claim 1 wherein said bushing is a generally cylindrical member, said bore extends axially along said member and is of substantially uniform diameter between said exposed end and said shunt path.

6. The assembly of claim 1 wherein said bushing includes a side notch communicating with said bore and forming said shunt path.

7. The assembly of claim 1 wherein said bore extends axially along said bushing and said shunt path extends perpendicular to said bore.

8. The assembly of claim 1 including an elongated fuse having one end secured within the bore of said bushing adjacent said shunt path, said fuse having an internal wall coating of a reactive material for initiating said charge in said cap.

9. A detonating cap bushing for interconnecting a fuse to a detonating cap while protecting a charge within the cap from static charge flow comprising an elongated cylindrical member having a first end for insertion into said cap and an exposed end opposite said first end, a longitudinal bore extending from said exposed end along said bushing to a point adjacent but spaced from said first end, said bore being open at said exposed end for receiving said fuse, said bushing having a rupturable membrane terminating said bore, said bushing further including a low resistance shunt path adjacent said membrane and extending laterally outwardly from said bore to the periphery of said bushing.

10. The bushing of claim 9 comprised of a one-piece unit made of semi-conductive plastic material.

11. The bushing of claim 9 wherein said shunt path includes a side notch forming an air passage between said bore and the exterior of the said bushing to provide said shunt path.

12. The bushing of claim 1 wherein said bore includes a shoulder adjacent said shunt path and said rupturable membrane is located intermediate said shoulder and said first end.

13. The bushing of claim 9 wherein said bore extends axially along said member and is of substantially uniform diameter between said exposed end of said shunt path.

14. The bushing of claim 1 wherein said bore extends axially along said bushing and said shunt path extends perpendicular to said bore.

* * * * *